United States Patent [19]

Yamazaki et al.

[11] 4,045,224

[45] Aug. 30, 1977

[54] METHOD FOR MAKING PHOSPHOR SCREEN FOR BLACK MATRIX TYPE COLOR PICTURE TUBE USING TWO LIGHT SOURCES

[75] Inventors: Eiichi Yamazaki, Ichihara; Hiromi Kanai, Mobara, both of Japan

[73] Assignee: Hitachi, Ltd., Japan

[21] Appl. No.: 425,710

[22] Filed: Dec. 18, 1973

[30] Foreign Application Priority Data

Dec. 25, 1972 Japan ..... 47-129266

[51] Int. Cl.[2] ..... G03C 5/00

[52] U.S. Cl. ..... 96/36.1; 354/1; 427/68

[58] Field of Search ..... 96/36.1; 117/33.5 CM; 313/92 CS, 92 B, 92 PD; 354/1; 427/68

[56] References Cited

U.S. PATENT DOCUMENTS

| | | | |
|---|---|---|---|
| 2,870,010 | 1/1959 | Sadowsky et al. | 96/36.1 |
| 3,226,246 | 12/1965 | Vermeulen et al. | 96/36.1 |
| 3,287,130 | 11/1966 | Kaplan | 96/36.1 |
| 3,615,462 | 10/1971 | Szegho et al. | 96/36.1 |
| 3,661,580 | 5/1972 | Mayaud | 96/36.1 |

*Primary Examiner*—Edward C. Kimlin
*Attorney, Agent, or Firm*—Craig & Antonelli

[57] ABSTRACT

A method for making a phosphor screen of a black matrix type color picture tube wherein use is made of two light sources, one being placed inside the faceplate of the tube and the other placed outside the faceplate, for carrying out a light exposure operation. An apparatus useful for such light exposure operation is also disclosed.

13 Claims, 5 Drawing Figures

METHOD FOR MAKING PHOSPHOR SCREEN FOR BLACK MATRIX TYPE COLOR PICTURE TUBE USING TWO LIGHT SOURCES

This invention relates to a method for making phosphor screens for color picture tubes, specially, those for black matrix type color picture tubes.

Heretofore, in order to increase brightness of the phosphor screen of the color picture tube, what is called a post-deflection focus color picture tube has been developed. However, in such a type color picture tube, a disadvantage was found that since a high focusing voltage must be applied between a shadow mask and the phosphor screen, secondary electrons generated within the color picture tube impinge on the phosphor screen under the influence of the high focusing voltage, so that color purity of images to be reproduced on the screen is deteriorated. Further, in order to prevent such deterioration of the color purity due to the secondary electrons and also to improve the contrast of picture images, what is called the black matrix type phosphor screen has been developed wherein phosphor areas of picture elements such as phosphor dots or stripes on the faceplate of the color picture tube are made rather small and the portions of the faceplate on which the phosphor does not exist are covered with a black material such as graphite.

In more detail, the black matrix type phosphor screen comprises a faceplate, a black material layer having holes arranged on the inner surface of the faceplate in a given pattern and a phosphor material filling the respective holes in the black material layer. The phosphor material may overlie the peripheral parts of the black material layer. The separated phosphor material members form a pattern comprising phosphor dots, stripes or the like. For the convenience of explanation, the phosphor material members refer hereinafter to these in dot shape. The black matrix type phosphor screen of such construction is made by firstly coating a black material on the inner surface of the faceplate in a certain pattern of layer, and, then applying a photosensitive phosphor material on the patterned black material layer as well as on the exposed portions of the inner surface of the faceplate so that the black material layer is embedded in the resulting phosphor layer having a plain surface, and exposing the phosphor material layer to light beams through mask apertures of a color selective electrode or shadow mask. In that case, the light beams through the color selective electrode would often impinge on areas other than intended areas of the phosphor layer. As a result, a disadvantage appears that the phosphor screen formed through a developing treatment includes phosphor dots overlapping with the adjacent phosphor dots to decrease the color purity of the picture images to be reproduced.

Therefore, an object of this invention is to provide a method for making phosphor screens for black matrix type color picture tubes free from the above-mentioned disadvantage, which can reproduce picture images of high color purity.

Another object of this invention is to provide a light exposure apparatus suitable for use with the above phosphor screen making method.

In accordance with one aspect of this invention, the method for making a phosphor screen for a black matrix type color picture tube having a faceplate, comprises the steps of forming a first pattern of a black material on the inner surface of the faceplate and forming a second pattern of phosphor materials, wherein the second pattern forming step includes applying a layer of a photosensitive phosphor material on the first pattern of the black material as well as on those portions on the inner surface of the faceplate on which the black material does not lie, exposing the photosensitive phosphor material layer to light from a light source passing through a color selective electrode inside the faceplate, further exposing the photosensitive phosphor material layer to light from at least one light source outside the faceplate and removing unwanted portions of said phosphor material layer.

In accordance with another aspect of this invention, the light exposure apparatus comprises light source means, an apertured mask placed on position with respect to the light source inside a faceplate of a color picture tube on which a phosphor screen is to be formed, wherein the light source means includes a first light source placed inside the faceplate and at least one second light source placed outside the faceplate.

This invention will now be described by way of example with reference to the accompanying drawings, in which.

Figure 1:
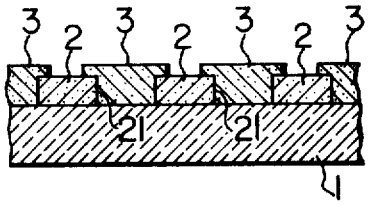
FIG. 1 is a sectional view of a phosphor screen of a black matrix type color picture tube.
Figure 2:
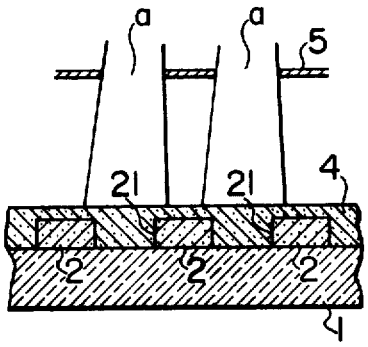
FIG. 2 is a sectional view useful for explaining a conventional method for making a black matrix type phosphor screen.
Figure 3:
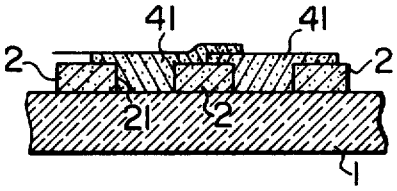
FIG. 3 is a sectional view showing that phosphor dots of the black matrix type phosphor screen at predetermined positions and in predetermined sizes.

Referring to FIG. 2, it is shown that a photosensitive phosphor material layer 4 is applied both on a black material layer 2 coated on the inner surface of a faceplate 1 in a certain pattern and on the exposed portions of the faceplate 1, the phosphor material layer having a plain surface and such a depth that the black material 2 is entirely embedded therein, and that the phosphor material layer 4 is exposed to light beams *a* which have passed through apertures in a color selective electrode 5 such as a shadow mask. In this Figure, a source of such light beams is not shown. If the light beams *a* are projected on the phosphor material layer 4 exactly at predetermined positions, then, using thereafter a photographic process, the phosphor screen as shown in FIG. 1 will be formed. In FIG. 1, reference numeral 2 indicates the black material, 3 phosphor material dots and 21 holes defined by the patterned black material layer 2 which are filled with the phosphor material dots 3. It can be said that the phosphor material dots should not exist over the black material. However, it is noted that, since with the light beams *a* (FIG. 2) having the same diameters as those of the matrix holes 21 in the black material layer, the phosphor dots, as a matter of fact, cannot be formed uniformly and exactly at the predetermined positions even though the light beams are slightly deviated, the diameters of the light beams are made a little bit greater than those of the matrix holes 21 to avoid such inconvenience. When the light beams *a* are projected on the photosensitive phosphor material layer 4, deviating to reach portions of the phosphor layer adjacent to their associated ones, the resulting phosphor screen will have adjacent phosphor dots of different kinds overlapped with each other as shown in FIG. 3 so that correct color reproduction of images are impossible.

Figure 4:
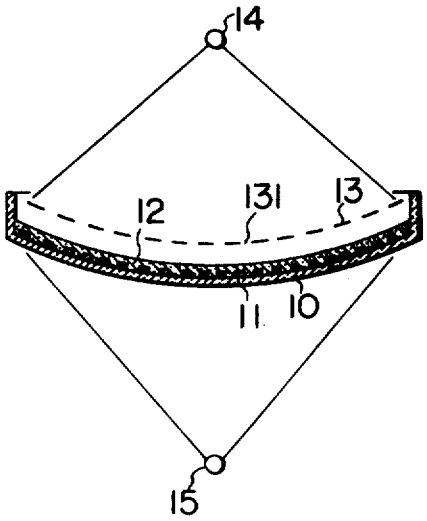
FIG. 4 is a view useful for explaining a method for making a phosphor screen for a black matrix type color picture tube and a light exposure apparatus, according to this invention.

In order to overcome the above-mentioned disadvantage, according to this invention, as is shown in FIG. 4, a black material layer 11 having holes in a predetermined arrangement or pattern is formed on the inner surface of a faceplate 10 by a conventional method, and then a photosensitive phosphor material layer 12 containing a photosensitive material such as photoresist is applied having its depth such that the layer 12 has a plain surface and the black material layer 11 is entirely embedded therein. Thereafter, the photosensitive phosphor material layer 12 is exposed to light beams from a source 14 projected thereon through the apertures 131 in a shadow mask 13 spaced by a predetermined distance from the faceplate 10.

The steps just mentioned are the same as in the prior art phosphor screen making method as has been explained in connection with FIG. 2. In the present invention, the faceplate 10 is also exposed to light from another light source 15 positioned at the opposite side to the light source 14 with respect to the faceplate 10. The light source 15 may be a plane light source. Therefore, the phosphor material layer 12 is exposed to light beams from the light source 15 passing through the holes in the black material layer 11 as well as those from the light source 14 passing through the apertures 131 in the shadow mask 13. The distance between the light source 15 and the faceplate 10 is selected at will because this, per se. is not critical, and this distance and the distance between the light source 14 and the faceplate 10 may be comparable, for example. Further, the light from the light source 15 may be collimated to impinge on the phosphor material layer. Also, in addition to the light source 15, one or more light sources may be provided on the same side as the light source 15.

Figure 5:
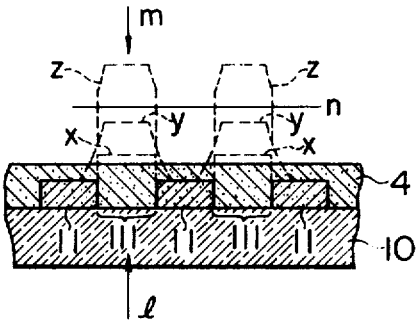
FIG. 5 is a view showing light quantity distribution where the light exposure is made by means of the method and apparatus shown in FIG. 4.

FIG. 5 shows light quantity distribution at and near the holes 111 in the black material layer 11 where the faceplate 10 is illuminated by the light beams on both sides of the faceplate in accordance with this invention. In this FIG., a curve *v* shows a light quantity distribution of light beam *m* emitted from the light source 14. It is clear from this curve *v* that the light quantity is large at areas corresponding to the holes 111 and is low at the circumference of the holes. A curve *x* shows a light quantity distribution of light beam *l* emitted from the other light source 15. It is clear from this curve *x* that the light quantity is high only at areas corresponding to the holes 111. Therefore, the actual light quantity distribution in the position at and near the holes becomes as shown by curve *z* which is substantially a sum of the curve *y* and the curve *x*. It is clear from this curve *z* that the light quantity is the largest in the areas corresponding to the holes 111 and gradually decreases as the distance from the holes 111 becomes great. A line *n* shows a threshold light quantity level to which the photosensitive phosphor material layer 12 must be exposed to light to define a phosphor pattern. As indicated by the curve *z*, at least those portions of the layer 12 which fill the holes 111 have received light quantity not lower than the threshold level *n*. Thus, a developing treatment given to the light-exposed phosphor material layer results in that portions of the phosphor material layer 12 which have received a quantity of light below the threshold level *n* is removed, and the whole of the other portions of the phosphor layer 12 which have received a quantity of light not lower than the threshold level *n* filling the holes 111 in the black material layer 11 are remained to form a phosphor pattern.

This invention has been described hereinbefore in connection with an embodiment thereof wherein the emission of light beams from the light source 15 to the photosensitive phosphor material layer 12 is effected after the emission of light to the layer 12 from the light source 14 on the opposite side of the faceplate to the light source 15. However, this invention is not limited to this embodiment, but illumination by the light source 15 may be made simultaneously with or before that by the light source 14.

Further, this invention is not limited to the embodiment wherein the holes in the black material layer coated on the faceplate is circular aperture pattern, but it is also applicable to a black material layer having another shaped holes, for example, stripe-like holes.

Furthermore, this invention has been explained using the shadow mask as the color selective electrode, but a stripe-like color selective electrode may equally be used.

What is claimed is:

1. A method for making a phosphor screen for a black matrix type color picture tube having a faceplate, comprising forming a first pattern of a black material on the inner surface of the faceplate, said first pattern defining areas in which black material does not cover the inner surface of said faceplate, pattern as well as on those areas of the inner surface of said faceplate not covered for black material, exposing said photosensitive phosphor material layer to light emitted from a first light source and passing through a color selective electrode positioned on the side of said faceplate defining the inner surface of said faceplate, the quantity of light from said first light source being larger at those portions of said photosensitive phosphor material layer corresponding to the areas of the inner surface of said faceplate not covered by said black material, exposing said photosensitive phosphor material layer to light from a second light source on the opposite side of said faceplate, said black material selectively controlling the light from said second light source whereby the quantity of light from said second light source is high only at the portions of the photosensitive phosphor material corresponding to the areas not covered by said black material, the quantity of light emitted either from said first light source or from said second light source being insufficient to activate said photosensitive material layer and the total quantities of light from said first and second light sources together being sufficient to activate said photosensitive material layer to thereby cooperatively limit the portions of the phosphor material layer remaining on said faceplate after subsequent development of said photosensitive phosphor material layer to the areas on the inner surface of said faceplate not covered by said black material, and developing said photosensitive phosphor material layer to remove those portions of said phosphor material layer covering said black material.

2. A method according to claim 1, wherein said areas are shaped in the form of dots.

3. A method according to claim 1, wherein said areas are shaped in the form of stripes.

4. The method of claim 1, wherein said first light source is a point light source.

5. The method of claim 1, wherein said first light source is a point light source.

6. In a process for making a phosphor screen for a black matrix type color picture tube in which a black matrix defining a pattern of open areas is applied to a first face of a picture tube faceplate, a layer of photosensitive phosphor material is applied to said black matrix and to said open areas, the portions of the photosensitive phosphor material layer in said open areas are exposed to a quantity of light of at least a predetermined threshold level sufficient to prevent removal of said portions upon subsequent development of said photosensitive phosphor material layer and said photosensitive phosphor material layer is developed to remove those portions of said photosensitive phosphor material layer not receiving the threshold quantity of light, the improvement wherein the portions of said photosensitive phosphor material layer in said open areas are exposed to light from a first light source positioned on the side of said faceplating defining said first face and in addition to light from a second light source positioned on an opposite side of said faceplate, the quantity of the light from said first light source and the quantity of the light from said second light source each being less than said threshold level; with the sum of the quantities of the light from the first and second light sources being not less than the threshold level whereby portions of said photosensitive phosphor material layer removed correspond to the portions covering said black matrix.

7. The process of claim 6, wherein said open areas are in the form of dots.

8. The process of claim 6, wherein said open areas are in the form of stripes.

9. The process of claim 6, wherein said first light source is a point light source.

10. The process of claim 9, wherein said second light source is a point light source.

11. The process of claim 6, wherein said second light source is a point light source.

12. The process of claim 6, wherein light from said first light source passes through a color selective electrode prior to reaching said photosensitive phosphor material layer.

13. In a process for making phosphor screen for a black matrix type color picture tube in which a black matrix defining a pattern of open areas is applied to one face of a picture tube faceplate, a photosensitive phosphor material layer is applied to said black matrix in such a way that a portion of the photosensitive phosphor material layer in at least some of said open areas are irradiated with a sufficient quantity of light so that upon subsequent development those portions of said photosensitive phosphor material layer so irradiated remain in place and said photosensitive phosphor material layer is developed to remove those portions of said photosensitive phosphor material layer not irradiated with said sufficient quantity of light, the improvement wherein at least a portion of the quantity of light irradiating those portions of the photosensitive phosphor material layer in said open areas is supplied from a light source positioned on the side of said faceplate opposite to the side carrying said black matrix, and another portion of the quantity of light irradiating those portions of the photosensitive phosphor material layer in said open areas is supplied from another light source positioned on that side of said faceplate carrying said black matrix, the quantity of light supplied from each side being less than a threshold light quantity level to which the photosensitive phosphor material must be exposed to define a phosphor pattern and the total quantity of light irradiating those portions of the photosensitive phosphor material layer in said open areas being not lower than the threshold light quantity level.

* * * * *